US010362404B2

(12) United States Patent
Junicho et al.

(10) Patent No.: US 10,362,404 B2
(45) Date of Patent: Jul. 23, 2019

(54) SPEAKER APPARATUS

(71) Applicants: Pioneer Corporation, Tokyo (JP); Tohoku Pioneer Corporation, Yamagata (JP)

(72) Inventors: Yoshitaka Junicho, Yamagata (JP); Kazuyuki Tamaya, Yamagata (JP); Satoshi Chiba, Yamagata (JP); Yohji Ogata, Yamagata (JP); Natsumi Ota, Yamagata (JP)

(73) Assignees: PIONEER CORPORATION, Tokyo (JP); TOHOKU PIONEER CORPORATION, Yamagata (JP)

( * ) Notice: Subject to any disclaimer, the term of this patent is extended or adjusted under 35 U.S.C. 154(b) by 0 days.

(21) Appl. No.: 15/507,253

(22) PCT Filed: Aug. 29, 2014

(86) PCT No.: PCT/JP2014/072777

§ 371 (c)(1),
(2) Date: Feb. 28, 2017

(87) PCT Pub. No.: WO2016/031060

PCT Pub. Date: Mar. 3, 2016

(65) Prior Publication Data

US 2017/0289696 A1 Oct. 5, 2017

(51) Int. Cl.

| | |
|---|---|
| ***H04R 1/02*** | (2006.01) |
| ***H04R 9/06*** | (2006.01) |
| ***H04R 1/28*** | (2006.01) |
| ***H04R 9/02*** | (2006.01) |

(52) U.S. Cl.

CPC ..... *H04R 9/06* (2013.01); *H04R 1/2896* (2013.01); *H04R 9/025* (2013.01); *H04R 2400/11* (2013.01)

(58) Field of Classification Search

CPC combination set(s) only.
See application file for complete search history.

(56) References Cited

U.S. PATENT DOCUMENTS 8,774,447 B2 * 7/2014 Ko ..... H04R 19/02 381/150
2010/0014704 A1 1/2010 Goschin et al.

FOREIGN PATENT DOCUMENTS

| | | |
|---|---|---|
| JP | 49146927 | 12/1974 |
| JP | 54135929 | 9/1979 |
| JP | 61195183 | 12/1986 |
| JP | 2005-057640 | 3/2005 |
| JP | 2009-536481 | 10/2009 |

OTHER PUBLICATIONS

International Search Report and Written Opinion PCT/JP2014/072777 dated Nov. 25, 2014.

* cited by examiner

*Primary Examiner* — Amir H Etesam
(74) *Attorney, Agent, or Firm* — Young & Thompson

(57) ABSTRACT

A frame is coupled to a magnetic circuit. The frame includes a plurality of holes which are formed outside the coupling portion and opened toward the magnetic circuit. A case covers the magnetic circuit and the frame, and is opened on a sound radiation direction side. An outer circumferential portion of the case is located on the sound radiation direction side beyond the plurality of holes and forms a first gap with respect to the frame. The first gap is communicated with an opening of the case.

11 Claims, 2 Drawing Sheets

SPEAKER APPARATUS

TECHNICAL FIELD

The present invention relates to a speaker apparatus.

BACKGROUND ART

As a speaker apparatus for preventing abnormal sound generated by entry of iron powder or magnetic powder into a magnetic gap, a speaker indicated in Patent Literature 1 has been proposed. The speaker of Patent Literature 1 includes a through-hole extending through a magnetic circuit at the center of the bottom surface of the magnetic circuit of the speaker. Iron powder or magnetic powder passes through a central hole formed through a frame and enters a through-hole of a yoke. Thus, abnormal sound generated by entry of iron powder or magnetic powder into a magnetic gap is prevented.

However, in a place where there is a lot of sand, the aforementioned dust measure is insufficient, and there is a risk that the dust enters the magnetic gap through an air hole of the yoke, resulting in drive failure.

CITATION LIST

Patent Literature

Patent Literature 1: JP 2005-57640 A

SUMMARY OF INVENTION

Technical Problem

An example of the object of the present invention is to cope with such a problem. Specifically, for example, an example of the object of the present invention is to provide a speaker apparatus that suppresses entry of dust into a magnetic gap.

Solution to Problem

In order to solve the problem, the present invention according to a first aspect is a speaker apparatus including: a magnetic circuit; a frame; and a case, wherein the frame includes a coupling portion to which the magnetic circuit is coupled, and a hole located outside the coupling portion, the case opening toward the frame covers the magnetic circuit and the frame, and a gap is formed between an edge end portion of the case, which is located outside the hole on an acoustic radiation side, and the frame.

DESCRIPTION OF EMBODIMENTS

Figure 1:
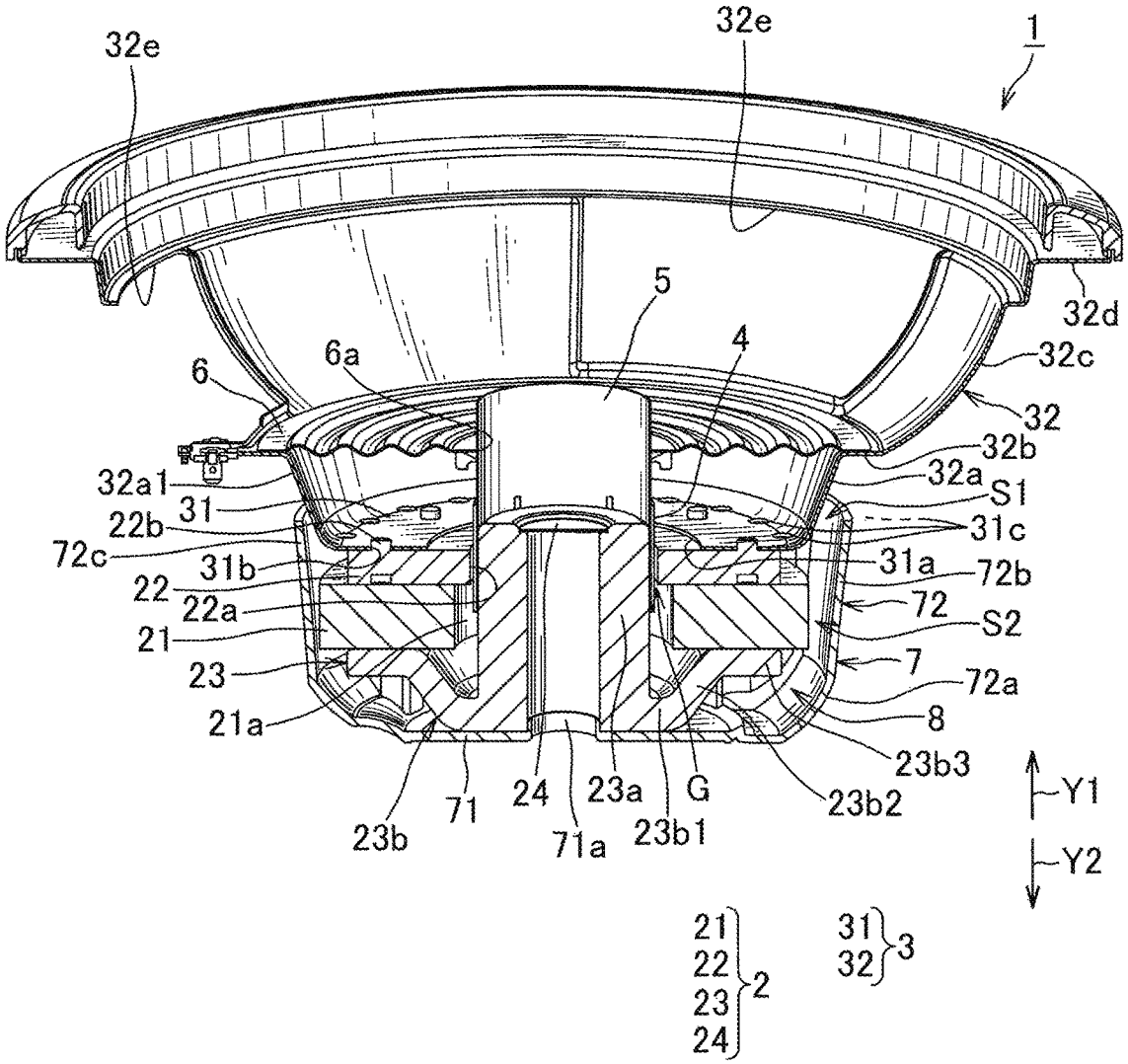
FIG. 1 is a cross-sectional perspective view illustrating a speaker apparatus of the present invention according to a first example.

A speaker apparatus according to an embodiment of the present invention is described below. A speaker apparatus according to an embodiment of the present invention includes: a magnetic circuit; a frame; and a case, wherein the frame includes a coupling portion to which the magnetic circuit is coupled, and a hole located outside the coupling portion and opening toward the case, the case opening toward the frame covers the magnetic circuit and the frame, and a gap is formed between an edge end portion of the case, which is located outside the hole on an acoustic radiation side, and the frame.

Thus, the entry route of dust (particularly, iron sand) to the magnetic gap is a route in which the dust travels in the direction opposite to a sound radiation direction through a gap located near an acoustic radiation side beyond holes of a frame, and then the dust is changed in direction, travels in the sound radiation direction, passes through the holes of the frame, and enters the inside of the frame to reach the magnetic gap. The dust is required to travel in the direction opposite to the sound radiation direction through the gap located near the acoustic radiation side beyond the holes of the frame. Therefore, the dust hardly enters the inside of the frame, and the entry of dust into the magnetic gap can be suppressed. Moreover, the dust (particularly, iron sand) which has entered through the gap is adhered to the magnetic circuit, which is coupled to the frame, by the magnetic force. Therefore, the dust further hardly enters the inside of the frame, and the entry of dust into the magnetic gap can be suppressed. Further, the hole may open toward the case.

In addition, the speaker apparatus includes a voice coil and a damper for supporting the voice coil on the frame. The damper may be attached to an inner surface of an outer circumferential portion of the frame, and a part of the outer circumferential portion of the frame located near the magnetic circuit with respect to the damper may be a continuous surface. Thus, the holes can be the only ports for entry of dust into the frame, which is located near the magnetic circuit side with respect to the damper. The entry of the dust (particularly, iron sand) into the magnetic gap can be further suppressed.

In addition, the hole may be formed through a bottom portion of the frame, and the gap may be formed between the outer circumferential portion of the frame and an outer circumferential portion of the case. The holes formed through the bottom portion of the frame are opened toward the frame or the magnetic circuit. Therefore, the dust cannot enter the inside of the frame through the holes without traveling in the direction opposite to the sound radiation direction through the gap located on the acoustic radiation side. Thus, the entry of the dust (particularly, iron sand) into the magnetic gap can be further suppressed.

In addition, an outer surface of the outer circumferential portion of the frame may include an inclination surface approaching the case in a direction toward the acoustic radiation side, and the edge end portion of the case may oppositely face the inclination surface of the frame. Thus, the gap near the opening of the case may be narrowed such that the dust hardly enters. The entry of the dust into the case is suppressed, and the entry of the dust into the magnetic gap can be suppressed.

In addition, the gap may be a first gap, a second gap may be formed between the outer circumferential portion of the case and the magnetic circuit, and the first gap and the second gap may be continuously formed from the edge end portion to the bottom portion of the case. Thus, as one dust entry route, a route is formed in which the dust, which has entered through the opening of the case, enters into the bottom portion of the case, which is away from the holes.

The dust which has entered along the route enters into the bottom portion. Therefore, suction toward the holes of the frame is suppressed.

The magnetic circuit may be an outer magnet-type magnetic circuit including a yoke, a magnet, and a plate, and an outer circumferential portion of the magnet of the magnetic circuit may be protruded toward the case beyond an outer circumferential portion of the yoke and an outer circumferential portion of the plate. Thus, since the intermediate portion of the second gap is narrowed, the dust which has entered through the opening of the case passed through the intermediate portion of the second gap, and entered into the bottom portion of the case, is further suppressed from being sucked toward the holes of the frame.

In addition, a part of the second gap near the bottom portion of the case with respect to the magnet may be formed to be wider than a part of the second gap in a position of the magnet. Because of this magnet, the intermediate portion of the second gap can be narrowed, and a part of the second gap near the bottom portion with respect to the intermediate portion can be formed wide. Thus, the dust, which has entered through the opening of the case, passed through the intermediate portion of the second gap, and entered into the bottom portion of the case, is further suppressed from being sucked toward the holes of the frame. Furthermore, when apart of the second gap near the bottom portion of the case is formed wide, an accommodation portion for accommodating the entry dust can be provided.

EXAMPLES

First Example

Next, a speaker apparatus according to the first example is described with reference to FIG. 1.

As illustrated in the drawing, a speaker apparatus 1 includes a magnetic circuit 2 formed with a magnetic gap G, a frame 3 to which the magnetic circuit 2 is coupled, a voice coil 4 inserted into the magnetic gap G, a coil bobbin (voice coil support) 5 for supporting the voice coil 4, a damper 6 for oscillatably supporting the coil bobbin 5, a diaphragm and a cap (neither of them is illustrated), and a case 7.

The magnetic circuit 2 according to the present example is an outer magnet-type magnetic circuit. The magnetic circuit 2 includes a magnet 21, a plate 22 to which one pole of the magnet 21 is magnetically connected, a yoke 23 to which the other pole of the magnet 21 is magnetically connected, and a mesh 24.

The magnet 21 is arranged in a disk shape and includes a through-hole 21*a* at the center.

The plate 22 is arranged in a disk shape. The plate 22 is placed on the surface of the magnet 21, which faces a sound radiation direction Y1 side (=one pole side), and is fixed by an adhesive or the like. The plate 22 also includes a through-hole 22*a* at the center.

The yoke 23 includes a yoke main body 23*a* having a cylindrical shape and inserted into the through-holes 21*a*, 22*a* of the aforementioned magnet 21 and plate 22, respectively, and a flange portion 23*b* protruding outward from the yoke main body 23*a*. The magnetic gap G is formed between the inner circumferential surface of the through-hole 22*a* of the aforementioned plate 22 and the yoke main body 23*a* inserted into the through-hole 22*a*. The magnetic gap G is opened on the sound radiation direction Y1 side and on the opposite direction Y2 side.

The flange portion 23*b* includes an inner circumferential portion 23*b*1 protruding outward from the end of the yoke main body 23*a* on the opposite direction Y2 side, an inclination portion 23*b*2 erecting from the outer end of the inner circumferential portion 23*b*1 in the sound radiation direction Y1 and departing from the yoke main body 23*a* in the sound radiation direction Y1, and an outer circumferential portion 23*b*3 formed to protrude outward from the end of the inclination portion 23*b*2 on the sound radiation direction Y1 side (i.e., formed parallel to the inner circumferential portion 23*b*1). The aforementioned inner circumferential portion 23*b*1 is mounted on a bottom portion 71 of the case 7 to be described below. The inclination portion 23*b*2 and the outer circumferential portion 23*b*3 are arranged at a distance from the case 7 to be described below. On the aforementioned outer circumferential portion 23*b*3, the surface of the magnet 21 facing the opposite direction Y2 side (=the other pole side) is placed and is fixed by an adhesive or the like.

The mesh 24 is attached to the end of the yoke main body 23*a* on the sound radiation direction Y1 side. The mesh 24 prevents entry of dust into the frame 3. The outside diameter (or width) of the aforementioned magnet 21 is formed to be greater than the outside diameter (or width) of the plate 22 and the outside diameter (or width) of the flange portion 23*b* of the yoke 23. Therefore, the magnet 21 is protruded toward the case 7 side to be described below beyond the plate 22 and the yoke 23.

The frame 3 is formed of resins such as polyethylene, polypropylene, and ABS. The frame 3 includes a bottom portion 31 and an outer circumferential portion 32 erecting from the edge end portion of the bottom portion 31 in the sound radiation direction Y1.

The bottom portion 31 of the frame 3 is arranged in a circular shape and includes a through-hole 31*a* formed at the center thereof, multiple coupling holes 31*b* surrounding the through-hole 31*a*, and multiple holes 31*c* further formed outside the coupling holes 31*b*. The yoke main body 23*a* and a coil support 5 to be described below are inserted into the through-hole 31*a*. Thus, the opening of the magnetic gap G is communicated with the through-hole 31*a* formed through the bottom portion 31 of the frame 3. Thus, when the dust enters the inside of the frame 3, the dust can enter the magnetic gap G through the through-hole 31*a* formed through the bottom portion 31.

The coupling holes 31*b* are holes through which the magnetic circuit 2 is coupled to the frame 3. Protrusions 22*b* protruding from the plate 22 are inserted into the coupling holes 31*b*. The magnetic circuit 2 is coupled to the frame 3 as the heads of the protrusions 22*b* are collapsed. The portion of the bottom portion 31 of the frame 3, which is in contact with the plate 22 (magnetic circuit 2), is a coupling portion. The multiple holes 31*c* are formed outside the coupling portion of the bottom portion 31 of the frame 3 and are opened toward the magnetic circuit 2. The air is delivered to the magnetic circuit 2 through the multiple holes 31*c* and cools the magnetic circuit 2.

The outer circumferential portion 32 of the frame 3 includes a first inclination portion 32*a*, a damper-mounting portion 32*b*, a second inclination portion 32*c*, and a diaphragm-mounting portion 32*d*. The first inclination portion 32*a* is formed to be contiguous with the bottom portion 31 and have an outside diameter (or width) that increases in the sound radiation direction Y1. Thus, an inclination surface 32*a*1 of which outside diameter (or width) increases in the sound radiation direction Y1 is formed on the outer surface of the first inclination portion 32*a*. The damper-mounting portion 32*b* is formed to outwardly protrude from the end of the first inclination portion 32*a* on the sound radiation direction Y1 side (i.e., formed substantially parallel to the bottom portion 31), and the outer circumferential edge (edge end portion) of the damper 6 to be described below is attached. The second inclination portion 32*c* is erected from the outer end of the damper-mounting portion 32*b* in the sound radiation direction Y1 and is arranged to have an outside diameter (or width) that increases in the sound radiation direction Y1. The diaphragm-mounting portion 32*d* is formed to outwardly protrude from the end of the second inclination portion 32*c* on the sound radiation direction Y1 side (i.e., formed substantially parallel to the bottom portion 31), and the outer circumferential edge (edge end portion) of a diaphragm to be described below, which is not illustrated, is attached.

A part of the outer circumferential portion 32 of the frame 3 located near the magnetic circuit 2 with respect to the damper 6 (i.e., the first inclination portion 32*a*) is a continuous surface without an opening. Apart of the outer circumferential portion 32 of the frame 3 located away from the magnetic circuit 2 with respect to the damper 6 (i.e., the second inclination portion 32*c*) includes multiple openings 32*e* for releasing the back pressure of the diaphragm, which is not illustrated.

The coil support 5 is arranged in a cylindrical shape, and the coil 4 is wound on the outer surface thereof. The damper 6 is formed of an elastic member in a circular shape. The damper 6 is formed to have a bellows shape from the outside to the center. The damper 6 includes a through-hole 6*a* at the center thereof through which the voice coil 4 is inserted. The coil support 5 is fixed to the inner surface of the through-hole 6*a* of the damper 6 by an adhesive or the like. Furthermore, the outer circumferential edge (edge end portion) of the damper 6 is fixed to the inner surface of the damper-mounting portion 32*b* of the frame 3 by an adhesive or the like.

The diaphragm, which is not illustrated, is formed of paper or plastic, e.g., polyetherimide. The diaphragm is arranged in a circular shape formed with a through-hole at the center. The coil support 5 is fixed to the inner surface of the through-hole of the diaphragm by an adhesive or the like. Furthermore, the outer circumferential edge (edge end portion) of the diaphragm is fixed to the inner surface of the diaphragm-mounting portion 32*d* of the frame 3 by an adhesive or the like. The cap, which is not illustrated, is fixed to the diaphragm to cover the coil support 5, which protrudes through the through-hole formed at the center of the diaphragm, which is not illustrated. Thus, when current is applied to the coil 4, the coil support 5 is oscillated by the magnetic force of the magnetic circuit 2, and the diaphragm, which is not illustrated, is oscillated to radiate sound.

The case 7 is formed of plastic such as polyethylene, polypropylene, and ABS. The case 7 covers the magnetic circuit 2 and the frame 3. The case 7 is opened toward the frame 3 (on the sound radiation direction Y1 side). The case 7 includes the bottom portion 71 and an outer circumferential portion 72 erected from the circumferential edge (edge end portion) of the bottom portion 71. Here, the magnetic circuit 2 may be partially or entirely covered by the case 7. For suppression of entry of dust into the magnetic circuit 2, it is preferable that the case 7 partially covers the magnetic circuit 2 such that the case 7 oppositely faces an outer circumferential surface of the magnetic circuit 2, which does not face the frame 3 but faces the outside as illustrated in FIG. 1. Furthermore, the frame 3 may be entirely covered by the case 7, or the frame 3 may be partially covered by the case 7 as illustrated in FIG. 1.

The aforementioned magnetic circuit 2 is mounted on the bottom portion 71, and the bottom portion 71 includes a communication hole 71*a*, which is communicated with the hole of the yoke main body 23*a* having a cylindrical shape.

The outer circumferential portion 72 of the case 7 is erected to the acoustic radiation side beyond the multiple holes 31*c* formed through the frame 3. Furthermore, the edge end portion 72*c* of the outer circumferential portion 72 is located outside the holes 31*c* and on the acoustic radiation side. A first gap S1 is formed between the outer circumferential portion 72 of the case 7 and the outer circumferential portion 32 of the frame 3. The first gap S1 is communicated with the opening of the case 7. Furthermore, the outer circumferential portion 72 of the case 7 forms a second gap S2 with respect to the magnetic circuit 2. The first gap S1 and the second gap S2 are continuously formed from the opening to the bottom portion 71 of the case 7.

The outer circumferential portion 72 of the case 7 includes a first inclination portion 72*a* and a second inclination portion 72*b*. The first inclination portion 72*a* is formed to be contiguous with the bottom portion 71 and to have an outside diameter (or width) that increases with distance from the bottom portion 71. The second inclination portion 72*b* is formed to be contiguous with the first inclination portion 72*a* and at an inclination angle greater than the inclination angle between the first inclination portion 72*a* and the bottom portion 71. The edge end portion of the second inclination portion 72*b* oppositely faces the inclination surface 32*a*1 of the outer circumferential portion 32 of the frame 3. Thus, the first gap S1 is formed to be the narrowest near the opening, which is a dust entry port, and to be wider in the opposite direction Y1.

Furthermore, as described above, the magnet 21 is arranged to protrude outward beyond the plate 22 and the yoke 23. Thus, the second gap S2 is narrow at an intermediate portion (a position between the outer circumferential portion 72 of the case 7 and the magnet 21) and is wide near the bottom portion 71 (a position between the outer circumferential portion 72 of the case 7 and the flange portion 23*b* of the yoke 23). Furthermore, the second gap S2 between the outer circumferential portion 32 of the frame 3 and the flange inclination portion 23*b*2 becomes larger as it approaches the bottom portion 71. A space between the frame 3 and the flange portion 23*b* of the yoke 23 is an accommodation portion 8 for accommodating dust entering through the opening of the case 7.

The speaker apparatus 1 with the aforementioned configuration requires that the holes 31*c* be formed through the bottom portion 31 of the frame 3 for cooling the magnetic circuit 2. In the present example, the case 7 for covering the magnetic circuit 2 and the frame 3 is arranged, the edge end portion 72*c* of the outer circumferential portion 72 of the case 7 is erected to the sound radiation direction Y1 side beyond the multiple holes 31*c*, the first gap S1 is formed between the outer circumferential portion 72 of the case 7 and the outer circumferential portion 32 of the frame 3, and the first gap S1 is communicated with the opening of the case 7.

Thus, the entry route of the dust (particularly, iron sand) to the magnetic gap G is a route in which the dust travels in the opposite direction Y2 side and enters the first gap S1 through the opening of the case 7, and then the dust is changed in direction, travels in the sound radiation direction Y1, enters the inside of the frame 3 through the holes 31*c*, and enters the magnetic gap G from the frame 3. Therefore, the dust hardly enters the inside of the frame 3, and the entry of the dust to the magnetic gap G can be suppressed.

Moreover, the dust (particularly, iron sand), which has entered through the opening of the case 7, is adhered to the magnetic circuit 2, which is coupled to the frame 3. Thus, the dust further hardly enters the inside of the frame 3, and the entry of the dust to the magnetic gap G can be suppressed.

Furthermore, the opening of the frame 3 is closed by the damper 6, the diaphragm or the gap, which are not illustrated. The outer circumferential portion 32 of the frame 3 located near the magnetic circuit 2 with respect to the damper 6 (i.e., the first inclination portion 32*a*) is formed of a continuous surface without an opening. Thus, the holes 31*c* can be the only dust entry ports into the frame 3, which is located near the magnetic circuit 2 with respect to the damper 6. The entry of the dust (particularly, iron sand) to the magnetic gap G can be further suppressed.

Furthermore, as far as the aforementioned speaker apparatus 1 is concerned, the edge end portion 72*c* of the outer circumferential portion 72 of the case 7 oppositely faces the inclination surface 32*a*1 of the frame 3. Thus, the first gap S1 near the opening of the case 7, which is a dust entry port, can be narrowed. The entry of the dust into the case 7 is suppressed, and the entry of the dust into the magnetic gap G can be further suppressed.

Furthermore, as far as the aforementioned speaker apparatus 1 is concerned, the outer circumferential portion 32 of the frame 3 forms the second gap S2 with respect to the magnetic circuit 2, and the first gap S1 and the second gap S2 are continuously formed to the bottom portion 71 of the case 7. Thus, the dust, which has entered the first gap S1 through the opening of the case 7, travels straight in the opposite direction Y2, passes through the second gap S2, enters into the bottom portion 71, and is stored in the accommodation portion 8. Thus, since the dust entering through the opening of the case 7 enters into the bottom portion 71 of the case 7, which is away from the holes 31*c*, the dust which has entered into the bottom portion 71 is suppressed from being sucked into the holes 31*c* of the frame 3.

Furthermore, as far as the aforementioned speaker apparatus 1 is concerned, the magnet 21 of the magnetic circuit 2 is protruded toward the case 7 beyond the plate 22 and the yoke 23. Thus, as described above, the second gap S2 is formed to be narrow at an intermediate portion and wide near the bottom portion 71. Thus, as the second gap S2 is arranged to have a narrow intermediate portion, the dust which has entered through the opening of the case 7 passed through the intermediate portion of the second gap S2, entered into the bottom portion 71 of the case 7, and has been stored in the accommodation portion 8, can be further suppressed from passing back through the narrow intermediate portion of the second gap S2 and being sucked into the holes 31*c* of the frame 3.

Second Example

Figure 2:
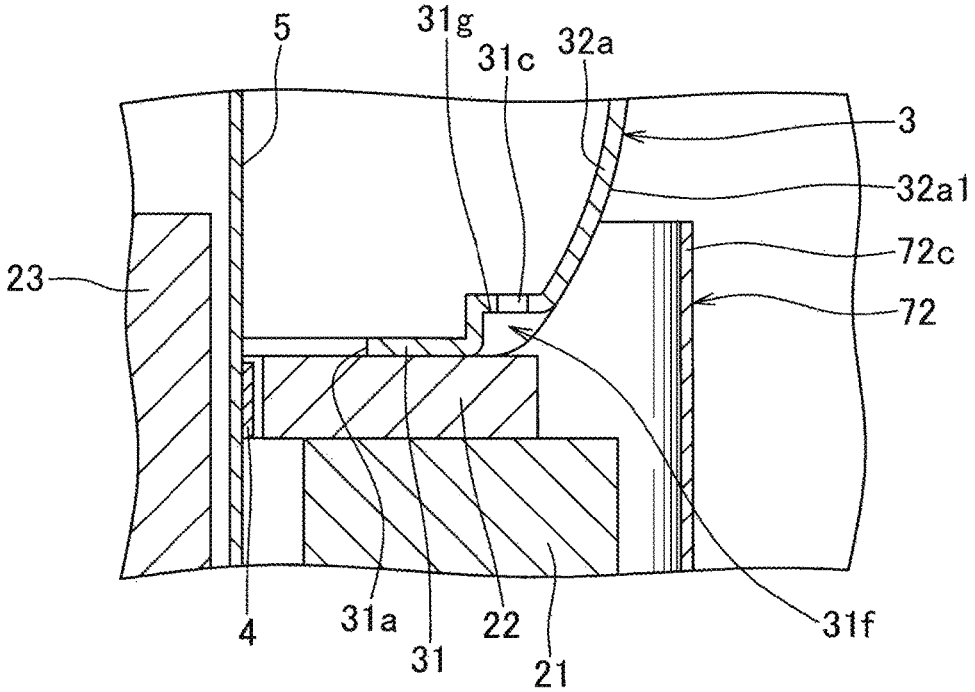
FIG. 2 is a partially cross-sectional view illustrating a speaker apparatus of the present invention according to a second example.
Figure 3:
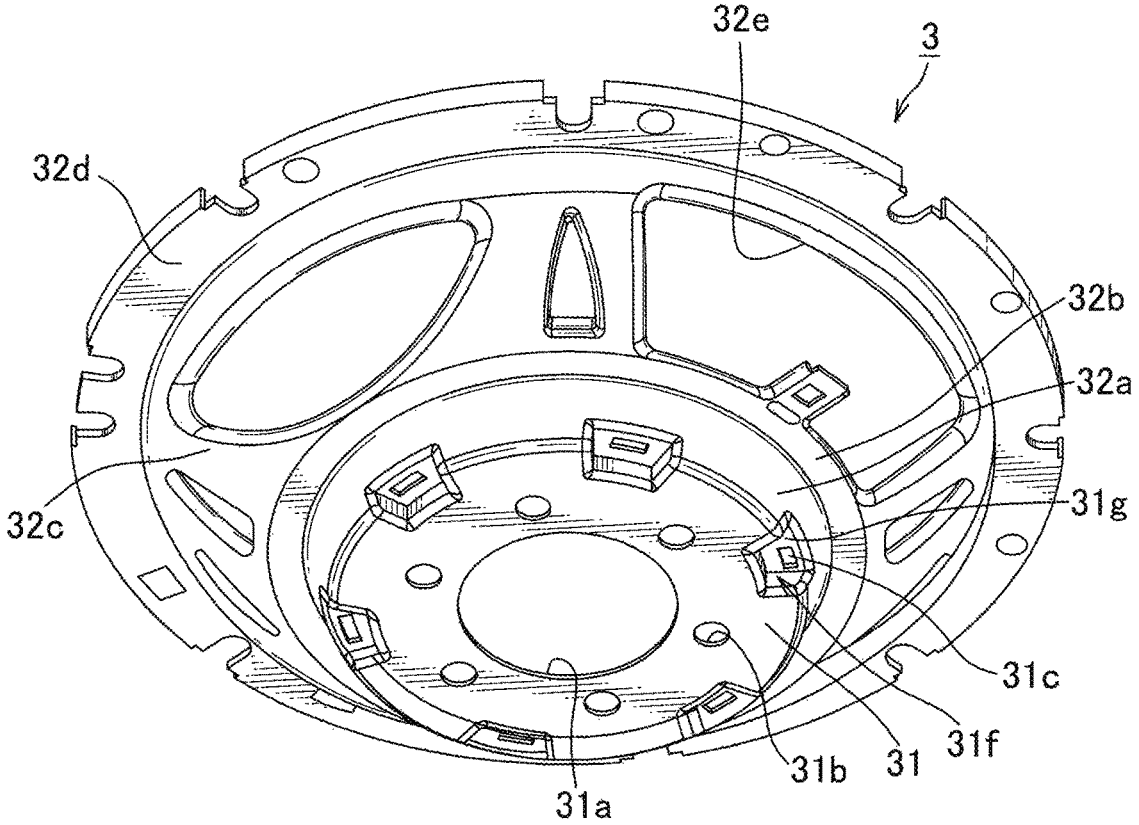
FIG. 3 is a perspective view of a frame constituting the speaker apparatus illustrated in FIG. 2.

Next, a speaker apparatus 1 according to the second example is described with reference to FIGS. 2 and 3. In FIGS. 2 and 3, parts equivalent to those of the speaker apparatus 1 illustrated in FIG. 1 already described in the first example are designated by like reference numerals, and the detailed description is omitted. The first example and the second example differ in shape of the frame 3. In the first example, the outside diameter (or width) of the plate 22 is smaller than the outside diameter (or width) of the bottom portion 31 of the frame 3, and the holes 31*c* are formed through the bottom portion 31.

Meanwhile, in the second example, as illustrated in FIG. 2, the outside diameter (or width) of the plate 22 is equal to or greater than the outside diameter (or width) of the bottom portion 31 of the frame 3. In this case, even when the holes 31*c* are formed through the bottom portion 31, the holes 31*c* are closed by the plate 22, rendering it difficult to deliver air into the magnetic circuit 2. Given the above, in the second example, multiple recessed portions 31*f* are formed as the outer circumferential edge of the bottom portion 31 is recessed toward the acoustic radiation side or toward the damper 6 side, and holes 31*c* are formed through upper surface portions 31*g* of the recessed portions 31*f*. The holes 31*c* are communicated with the outside through openings of the recessed portions 31*f*. Furthermore, a part of the circumference of the holes 31*c* is surrounded by side surfaces that define the recessed portions 31*f*. Thus, the holes 31*c* are closed by the plate 22 making it difficult to deliver the air. Moreover, when the holes 31*c* are formed in the recessed portions 31*f* as in the second example, the side surfaces defining the recessed portions 31*f* become walls, narrowing the dust entry route to the holes 31*c*, thereby enabling further suppression of dust entry into the frame 3 through the holes 31*c*.

According to the aforementioned first and second examples, the second gap S2 is also provided between the outer circumferential portion 72 of the case 7 and the magnetic circuit 2, but the present invention is not limited thereto. Depending on the degree of dust, only the first gap S1 between the outer circumferential portion 72 of the case 7 and the outer circumferential portion 32 of the frame 3 may be provided.

Furthermore, according to the aforementioned first and second examples, the inclination surface 32*a*1 is formed on the outer circumferential portion 32 of the frame 3, and the end of the outer circumferential portion 72 of the case 7 near the opening oppositely faces the inclination surface 32*a*1, but the present invention is not limited thereto. The inclination surface 32*a*1 may not necessarily be formed on the outer circumferential portion 32 of the frame 3, but the surface may be perpendicular to the bottom portion 31.

Furthermore, according to the aforementioned first and second examples, the magnet 21 is protruded to the case 7 beyond the yoke 23 and the plate 22 so that the second gap S2 is formed to be narrow at an intermediate portion and wide near the bottom portion 71, but the present invention is not limited thereto. The intermediate portion of the outer circumferential portion 72 of the case 7 may be recessed inward so that the second gap S2 is formed to be narrow at an intermediate portion and wide near the bottom portion 71.

Furthermore, according to the aforementioned first and second examples, the second gap S2 is formed to be narrow at an intermediate portion and wide near the bottom portion 71, but the present invention is not limited thereto. The second gap S2 may be formed to have the same dimension toward the bottom portion 71.

Furthermore, according to the aforementioned first and second examples, the magnetic circuit 2 is an outer magnet-type magnetic circuit, but the present invention is not limited thereto. The magnetic circuit 2 may be an inner magnet-type magnetic circuit. When an inner magnet-type magnetic circuit is employed, the outer circumferential portion of the yoke may be protruded toward the case beyond the magnet and the plate, so that the second gap 2S can be narrow at an intermediate portion and a part of the second gap 2S near the bottom portion 71 can be wide.

As an example of mounting the speaker apparatus 1, the speaker apparatus 1 is arranged in a trunk room of a vehicle.

In this case, for example, the speaker apparatus 1 is arranged such that the sound radiation direction Y1 faces the roof of the vehicle or an occupant, e.g., a driver.

Furthermore, the aforementioned examples merely indicate representative aspects of the present invention, and the present invention is not limited to the embodiments. Specifically, various variations may be carried out without departing from the gist of the present invention. The magnet 21 and the plate 22 may be formed concentrically. The inclination angle of the second inclination portion 72*b* with respect to the bottom portion 71 may be substantially perpendicular. The holes 31*c* may be of any shape, such as true circle, oval, a track shape, and rectangle, such as a square shape and an oblong shape.

REFERENCE SIGNS LIST

1 speaker apparatus
2 magnetic circuit
3 frame
6 damper
7 case
21 magnet
22 plate
23 yoke
31 bottom portion
31*c* hole
32 outer circumferential portion
32*a*1 inclination surface
71 bottom portion
72 outer circumferential portion
S1 first gap
S2 second gap
Y1 sound radiation direction

The invention claimed is:

1. A speaker apparatus comprising:
a magnetic circuit;
a frame; and
a case, wherein
the frame includes a coupling portion to which the magnetic circuit is coupled at an acoustic radiation side face, and a hole located outside the coupling portion,
the case opening toward the frame covers the magnetic circuit and the frame, and
a gap is formed between an edge end portion of the case, which is located outside the hole on the acoustic radiation side, and the frame,
wherein the magnetic circuit is an outer magnet-type magnetic circuit including a yoke, a magnet, and a plate, and
an outer circumferential portion of the magnet of the magnetic circuit is protruded toward the case beyond an outer circumferential portion of the yoke and an outer circumferential portion of the plate.

2. The speaker apparatus according to claim 1, wherein the hole opens toward the case.

3. The speaker apparatus according to claim 1, further comprising:
a voice coil, and
a damper configured to support the voice coil on the frame,
wherein the damper is attached to an inner surface of an outer circumferential portion of the frame, and
a part of the outer circumferential portion of the frame located near the magnetic circuit with respect to the damper is a continuous surface.

4. The speaker apparatus according to claim 1, wherein
the hole is formed through a bottom portion of the frame, and
the gap is formed between the outer circumferential portion of the frame and an outer circumferential portion of the case.

5. The speaker apparatus according to claim 1, wherein
an outer surface of the outer circumferential portion of the frame includes an inclination surface approaching the case in a direction toward the acoustic radiation side, and
the edge end portion of the case oppositely faces the inclination surface of the frame.

6. The speaker apparatus according to claim 1, wherein
the gap is a first gap,
a second gap is formed between the outer circumferential portion of the case and the magnetic circuit, and
the first gap and the second gap are continuously formed from the edge end portion to the bottom portion of the case.

7. The speaker apparatus according to claim 6, wherein
a part of the second gap near the bottom portion of the case with respect to the magnet is formed to be wider than a part of the second gap in a position of the magnet.

8. The speaker apparatus according to claim 1,
wherein the frame has multiple holes formed outside of the coupling portion from the center in a radial direction circumferentially.

9. The speaker apparatus according to claim 1,
wherein the frame is formed of at least one resin.

10. The speaker apparatus according to claim 1,
wherein the frame is connected to the plate of the magnetic circuit.

11. The speaker apparatus according to claim 1,
wherein the frame, the magnetic circuit, and the case are arranged in this order with respect to an acoustic radiation direction.

* * * * *